US005971435A

United States Patent [19]

DiCesare et al.

[11] Patent Number: 5,971,435

[45] Date of Patent: Oct. 26, 1999

[54] METHOD AND SYSTEM FOR VERIFYING THE AUTHENTICITY OF AN AUTOGRAPH

[76] Inventors: Robert D. DiCesare, 8930 Greenbriar Ter. South, Boston, N.Y. 14025; Darryl Najewski, 101 Nanette Dr., Elma, N.Y. 14059

[21] Appl. No.: 08/988,459

[22] Filed: Dec. 10, 1997

[51] Int. Cl.[6] ..... B42D 15/00; B42D 15/10

[52] U.S. Cl. ..... 283/70; 283/60.1; 283/67; 283/72

[58] Field of Search ..... 283/60.1, 67, 70, 283/72

[56] References Cited

U.S. PATENT DOCUMENTS

| | | | |
|---|---|---|---|
| 5,289,547 | 2/1994 | Ligas et al. | 283/72 |
| 5,737,886 | 4/1998 | Kruckemeyer | 283/67 |
| 5,873,305 | 2/1999 | Dell'olmo | 283/72 |

*Primary Examiner*—Willmon Fridie, Jr.
*Assistant Examiner*—Mark T. Henderson
*Attorney, Agent, or Firm*—Arthur S. Cookfair; James J. Ralabate

[57] ABSTRACT

A method and system for verifying the authenticity and ownership of an autograph comprises:

providing a consumer-owned article; and having the article autographed with the consumer and a representative of an authentication company as witnesses;

issuing a voucher bearing details of the autographing and signatures and identification of the witnesses and an identifying code number;

affixing the same identifying code number to the article;

providing a certificate of authenticity bearing a distinct code number that is different from the code number of the article and the voucher, and containing a description of the article, details of the signing and witnessing of the autographing, and identification of the owner of the article; and providing a database containing details of the signing and witnessing of the autographing, a record of the code numbers on the article and the certificate; and identification of the owner of the article.

The method also provides a record of subsequent transfers of ownership of the article.

19 Claims, 4 Drawing Sheets

METHOD AND SYSTEM FOR VERIFYING THE AUTHENTICITY OF AN AUTOGRAPH

BACKGROUND OF THE INVENTION

1. Field of the Invention

The present invention relates to a method and system for the recordation and authentication of an autograph, such as on an autographed item of memorabilia.

2. Description of the Prior Art

Articles associated with a particular event, activity or person of interest are often collected and saved as memorabilia by collectors, enthusiasts, hobbyists or the like who may value them for various reasons, such as historical interest, or even for sentimental reasons. In addition to their value as keepsakes, memorabilia often have a monetary value that may increase with time. A typical form of memorabilia is an article that is closely associated with a particular event or activity that it represents. In some instances the article may have been autographed by someone whose name and fame is popularly associated with the event or activity, such as a baseball autographed by a famous baseball player. Such articles are often- sold to collectors or enthusiasts at prices that may depend on factors such as the rarity or age of the article. Unfortunately, the monetary value of such articles creates an incentive for counterfeiting and as a result, there is a need to provide a system whereby the authenticity of an article can be conveniently verified. Although the prior art systems are useful for establishing the authenticity of an article, they are limited in various ways.

U.S. Pat. No. 5,267,756 discloses a system for the authentication of an article wherein a hologram bearing a unique code number is affixed to the article and the article is accompanied by a certificate of authenticity bearing a hologram with the same unique code number thereon. A master record of the unique code number and related article is maintained. A registration "hotline" is provided whereby a person purchasing the article can register it by mail or telephone and the authenticity of the article can be verified through the registration hotline.

U.S. Pat. No. 5,380,047 discloses an authentication system similar to that disclosed in U.S. Pat. No. 5,267,756 wherein both the article and the certificate of authenticity have thereon an image-bearing medium with the unique code number printed on it. However, the image-bearing medium does not have to be a hologram.

U.S. Pat. No. 5,401,561 discloses the application of an identification label to an item, wherein the label is not visible to the human eye under "normal" visible light illumination, but becomes visible when illuminated by a "light source" at a specific wavelength outside of the visible light spectrum.

U.S. Pat. No. 5,128,779 discloses the application of a hologram or diffraction pattern to a substrate bearing visual information in the form of written and/or graphic or photographic information. The hologram or diffraction is affixed to the substrate by a transparent adhesive and serves to protect the visual information and render alteration thereof difficult.

U.S. Pat. No. 5,306,899 discloses a method and apparatus for automatically authenticating a holographic display element by directing light on the display and directing the reflected beam to a holographic record made from an authentic version of the holographic display element. The method and apparatus may also incorporate a bar code display and bar code reader.

Sport Collectors Digest, Sep. 19, 1997, reports a system of authenticating autographed articles wherein a representative of an authenticating company attends a signing and authenticates the items signed with a hologram and places a matching number on a certificate of authenticity, then catalogs each item in a database for future reference by collectors.

The most common prior art methods for authentication of an autographed article involve a "mass production" of autographed articles. For example, a company desirous of selling authenticated autographed articles may obtain a large number of items to be autographed, then arrange for a celebrity whose autograph is desired to sign the items in the presence of a representative of the company. The representative then serves as witness to the signing for purposes of authentication. Authentication records are then prepared for each autographed item; the celebrity who autographed the items is paid a fee; and the autographed items are offered for sale to the public. One of the disadvantages of such a procedure is that the consumer, that is, the person who subsequently purchases and owns the autographed item is offered little opportunity for personal involvement in the process or even an opportunity to witness the actual signing of the autograph.

Typically, in the prior art authentication systems, a code number is affixed to the article and the same code number is imprinted on a certificate of authenticity that will accompany the item when it is sold to the customer. The possibility of counterfeiting is more likely when the same code number is used on both the item and the certificate since a person who comes into possession of either would know the number that must appear on a counterfeit version of the other.

Although the systems disclosed in the prior art are useful for the purpose intended, it will be appreciated by those skilled in the art that a system providing a higher degree of convenience and, at the same time greater security, would be desirable.

It is an object of this invention to provide a system for verifying the authenticity and ownership of an autograph and autographed article, wherein the system provides a greater degree of security than do the systems of the prior art.

It is a further object to provide a system for verifying the authenticity and ownership of an autographed article that allows an opportunity for the customer (consumer) to become personally involved in the process of selecting the article, obtaining the autograph and witnessing the signing of the autograph.

It is a further object to provide a method and system that permits the maintenance of a history of sales and transfer of ownership of an autograph.

SUMMARY OF THE INVENTION

This invention relates to a method and system for verifying the authenticity and ownership of an autograph comprising the steps of:

A) providing a consumer-owned article to be autographed;

B) having the article autographed by a person whose autograph is desired by the consumer;

C) having the consumer and a representative of an authentication company witness the autographing;

D) providing a voucher containing: a description of the article; the date, place of the autographing of the article; identification and signatures of the consumer and the representative as witnesses to the autographing of the article; identification of the person who autographed the article; and an identifying code number;

E) affixing to the autographed article an identifying code number identical to the identifying code number on said voucher;

F) providing a certificate of authenticity containing: a description of the article together with the date and place of the signing of the autograph; the name of the person who signed the autograph; the name and address of the owner of the article and who witnessed the signing of the autograph; and a distinct code number that is different from the code number of steps D) and E);

G) providing a database containing: the distinct code number contained in the certificate of authenticity of step E); the identifying code number affixed to said article and said voucher; the name and address of the consumer and the name of the representative, both of whom witnessed the autographing of the article; and a description of the article; the date and place of the autographing; and the name of the person who autographed the article.

The recordation of specific circumstances at the time the autograph is acquired may contribute strongly to the subsequent value of the article. It is an advantage of the present system that those specific circumstances are witnessed by two persons and thus become a part of the record of authenticity. Typically, the two persons who serve as witnesses are 1) the consumer, that is, the person who owns the article and 2) a representative of the company or organization that manages the authentication system.

The identifying code number may be affixed to the article, for example, by encasing the number in a plastic strip and applying it to the article with a tamper proof adhesive so that it may not be removed without marring the surface of the article, leaving evidence of the removal, and destroying the identifying code number.

Optionally, the authentication certificate may display a logo identifying the authentication company or, in some instance, identifying a sponsoring institution or other entity. The logo maybe be displayed in various ways, for example, in the form of an impression or seal, or preferably, in the form of a hologram.

The database may be an electronic database, such as a computer-controlled electronic file, containing the desired information. The electronic file may be supplemented by a physical file containing pertinent physical documentation, such as the original voucher signed by the witnesses to the autographing.

If the autographed article is subsequently sold by the original owner, the purchaser may verify its authenticity by contacting the authenticating company. The code number on the article as well as the number and other information on the certificate will be compared to the information in the database to verify authenticity. A request signed by the current owner as well as the new owner together with other information, such as the address of the new owner is then submitted to the authentication company and the certificate of authenticity is surrendered. A new certificate of authenticity, recognizing the new owner, is then issued by the company. The procedure may be repeated in the event of subsequent transfers of ownership. When a new certificate of authenticity is issued it will display a new code number and its issuance will void any previous certificate(s). For convenience, an ownership transfer form may be printed on the other side of the certificate of authenticity (see FIG. 3*b*).

BRIEF DESCRIPTION OF THE DRAWINGS

The present invention and the manner in which it may be practiced is further illustrated with respect to the accompanying drawings wherein.

DETAILED DESCRIPTION

Figure 1:
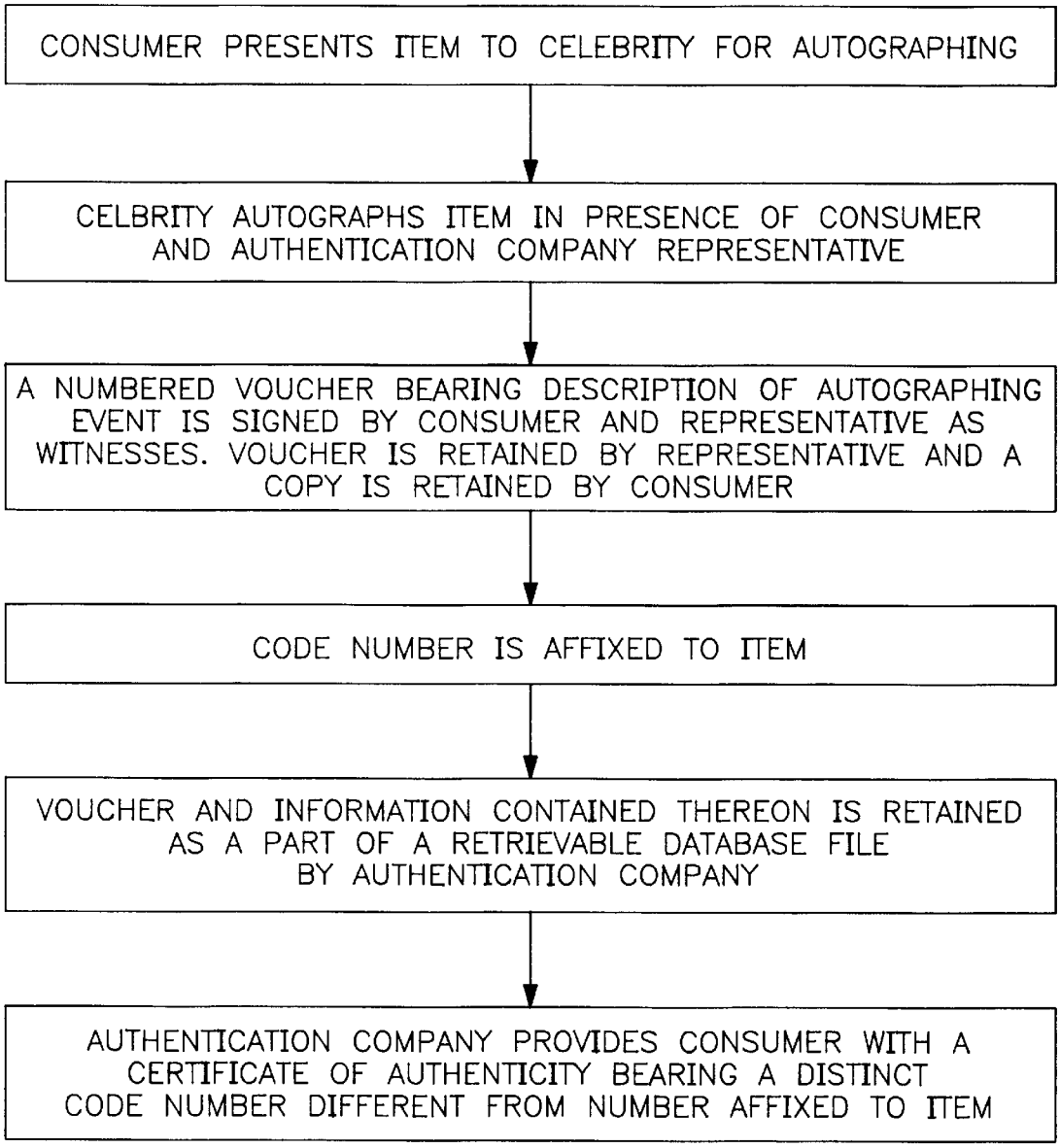
FIG. 1 is a flow diagram outlining the steps of the invention.

The steps to be followed in practicing the present system are set forth broadly in flow diagram form in FIG. 1. The item (article) to be autographed, as referred to therein, may be any article, selected by the consumer. Typically, the article will be one that is associated in some way with the celebrity that autographs it, such as a football, if the celebrity is a football player.

Figure 2:
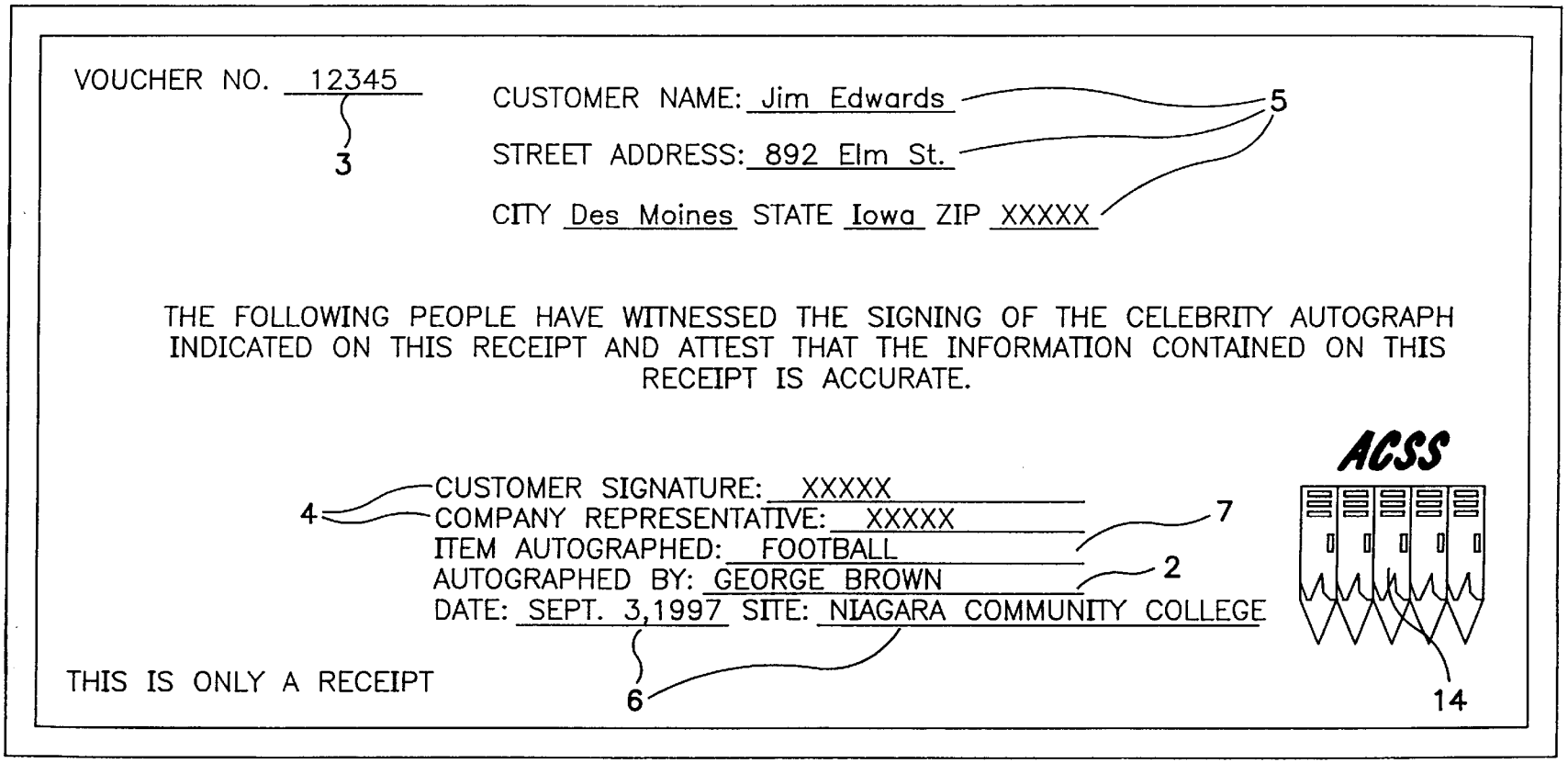
FIG. 2 is a drawing depicting an example of a voucher to be used in the system of the invention.

A voucher, as depicted in FIG. 2, may be used at the time of the autographing and provides a record of the signatures 4 of the witnesses to the autographing, as well as the name and address of the consumer (customer) 5, the date and place of the autographing 6; an identification or description of the article autographed 7 and the name of the celebrity 2 who autographed the article. In practice, the voucher is signed and completed at the time of autographing. The voucher number 3 corresponds to a code number affixed to the article. For convenience, some of the information may be completed in advance. The original of the voucher is retained by the representative for subsequent entry into the authentication company computer database. A copy may be given to the consumer after signing. In addition to the entry of the information from the voucher into the company's computer database, the voucher itself may be retained as a part of the database in a physical file.

Alternatively, the information, including the witnesses' signatures, may be directly transmitted electronically to the computer database from the site of the autographing or other remote location.

Figure 3A:
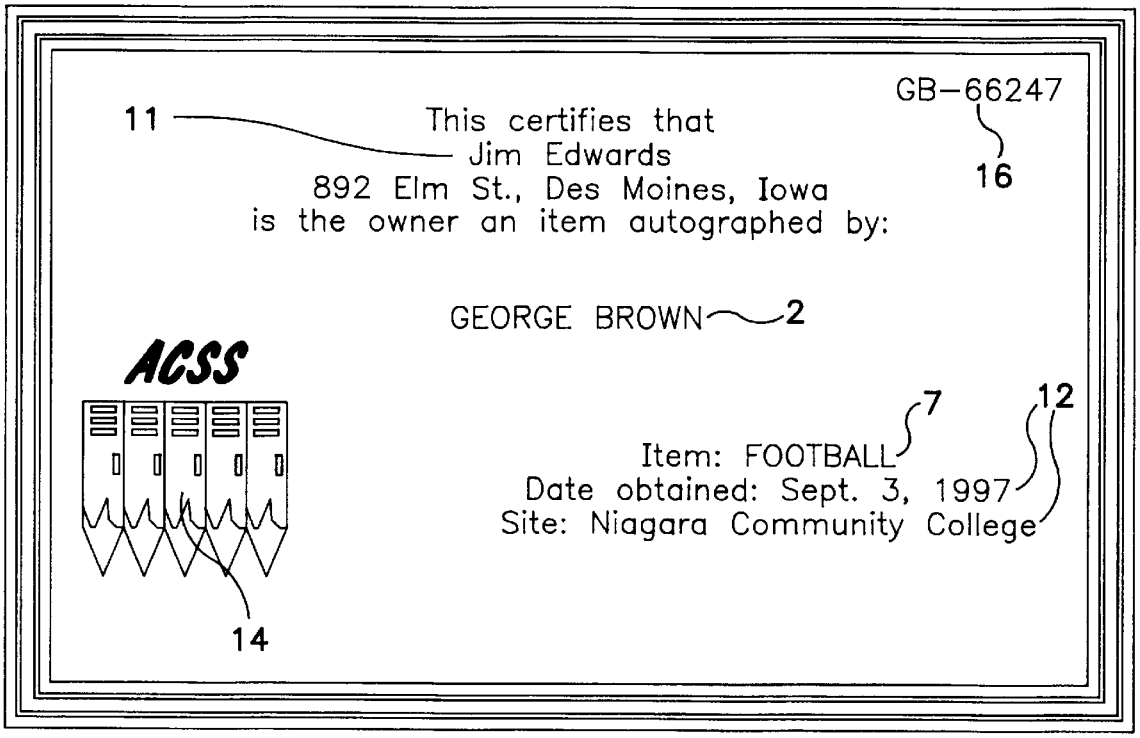
FIGS. 3*a* and 3*b* depict an example of the front and back of a certificate of authenticity to be used in the system of the invention.
Figure 3B:
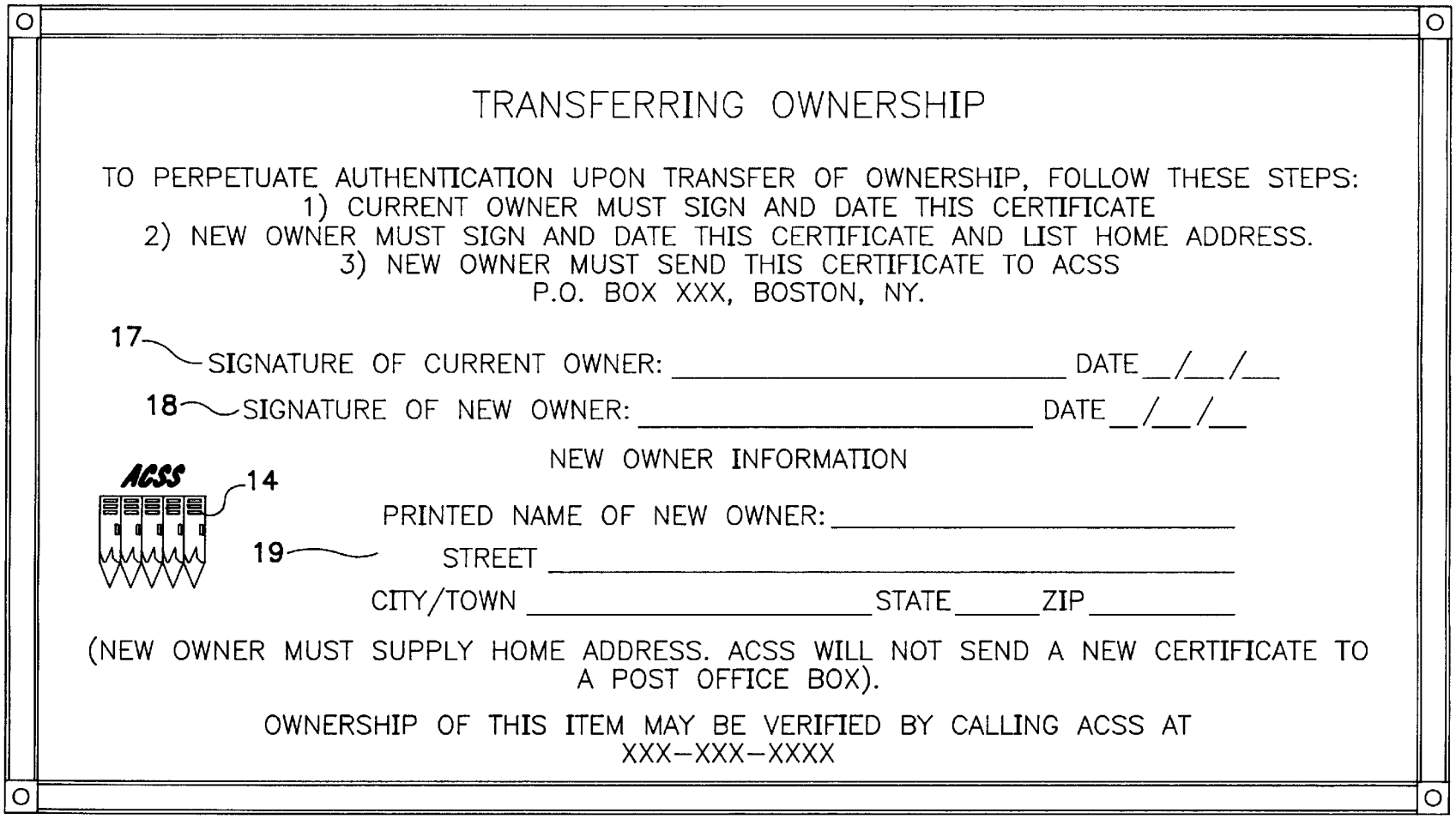

The front of the certificate of authenticity (FIG. 3*a*) sets forth the name and address of the consumer (owner) 7 of the autographed article and identifies the article 16 and the name of the person 2 who autographed the article. The date and place of the autographing 12 are also shown and a unique code number 16 is applied to the certificate. The authentication company is identified by the logo 14 on the certificate, as well as on the voucher. The back of the certificate of authenticity (FIG. 3*b*) may be used, as shown, for a subsequent transfer of ownership. The transfer of ownership, as shown, requires the signatures of the current owner 17, as well as the new owner 18 and the name and address of the new owner 19. In practice, when this information and the signatures are presented to the authentication company together with the surrender of the old certificate, a new certificate of authenticity will be issued and the database will be updated to reflect the change in ownership and the database will show a history of ownership.

A wide variety of specific circumstances may be associated with the signing of an autograph and the authentication thereof, as illustrated by the following examples:

EXAMPLE 1

A well-known baseball player holds an autograph session wherein various articles, such as baseballs, bats, and the like are presented by their owners to be autographed. In accordance with the present system, a consumer desirous of acquiring an autograph, is in attendance together with a representative of the organization that manages the authentication system. Both the consumer and the representative witness the autographing of the article. The consumer then retains the autographed article. The representative then provides a numbered voucher containing the name and address of the consumer, a description of the autographed article, the date and place of the autographing and, optionally, any other specific circumstances associated with the article and/or the autographing thereof, and the name of the baseball player that autographed the article.

The voucher is then signed by the consumer and the representative as witnesses to the autographing event. The consumer is given a copy of the completed voucher and the representative retains the original, which may then become a part of the database record to be maintained by the organization that manages the authentication system. The representative affixes to the article an identifying code number that is the same as the identifying code number on the voucher. Preferably the code number is placed on the article in a secure manner, for example, on a label secure from alteration and affixed to the article with a tamperproof adhesive.

The authentication company, i.e. the organization that manages the authentication system subsequently provides the consumer with a certificate of authenticity containing a description of the autographed article, the name and address of the consumer, the date and place of the autographing, the name of the autograph signer, and a distinct code number that is not the same as the code number affixed to the article.

The information shown on the certificate of authenticity as well as the name of the representative who witnessed the autographing, is entered into a database, from which the information may be subsequently retrieved.

EXAMPLE 2

The owner of a book, accompanied by a representative of the authentication company, presents the book to the author of the book at a public autographing session and the author signs the book. Both the book owner and the representative witness the autographing. The system of authentication is then carried out in a manner similar to that of Example 1, that is, the representative provides a numbered voucher describing the book and the date, place and other specific circumstances under which the book was autographed. A number identical to that on the voucher is affixed to the book.

Although the invention has been described with reference to certain preferred embodiments, it will be appreciated that modifications and variations may be made without departing from the spirit of the invention as defined by the appended claims.

What is claimed is:

1. A method for verifying the authenticity of an autograph comprising the steps of:

A) having a consumer provide an article to be autographed;

B) having the article autographed by a celebrity whose autograph is desired by the consumer;

C) having the consumer and a representative of an authenticating company witness the autographing;

D) providing a voucher containing: a description of the article; a date and place of the autographing of the article; identification and signatures of the consumer and the representative, as witnesses to the autographing of the article; identification of a person who autographed the article; and an identifying code number;

E) affixing to the article an identifying code number;

F) providing to the consumer a certificate of authenticity issued by the authentication company and containing: a description of the article together with the date and place of the autographing; a name of the celebrity who autographed the article; identification of consumer to whom the article belongs and who was witness to the autographing; and a distinct code number that is different from the code number of step D and step E;

G) providing a database containing: the distinct code number set forth on the certificate of authenticity; the identifying code number affixed to the article; identification of the consumer and the name of representative; both of whom witnesses the autographing; a description of the article; identification of the person who autographed the article; and the date, and place of the autographing.

2. A method according to claim 1 wherein said voucher is retained by the representative for subsequent entry into the database and a copy of said voucher is given to consumer.

3. A method according to claim 1 wherein the code number on the voucher is the same as the code number on the article.

4. A method according to claim 1 wherein the database comprises a computer-controlled electronic file.

5. A method according to claim 4 wherein the database further comprises a physical file containing the voucher.

6. A method according to claim 1 wherein the certificate of authenticity bears a logo identifying an entity associated with obtaining and authenticating the autographed article.

7. A method according to claim 6 wherein the entity is said authentication company.

8. A method according to claim 6 wherein the entity is a sponsoring institution.

9. A method according to claim 2 wherein the article is an article associated with a sport and is autographed by a celebrity associated with said sport.

10. A method according to claim 2 wherein the article is a book autographed by an author.

11. A method according to claim 5 wherein said article is subsequently sold by said consumer to a new owner and ownership of the article is transferred to the new owner by the steps of a) having the consumer and the new owner submit a signed request to the authentication company for a new certificate of authenticity;

b)having the consumer surrender the certificate of authenticity to the authentication company.

c)having the authentication company issue a new certificate of authenticity bearing a new code number; a description of the article; identification of the new owner; the date and place of the autographing: and the name of the celebrity who autographed the article.

d) having the details of the transfer of ownership entered into the database to maintain a history of ownership of said article; and e) placing the surrendered certificate of authenticity in the physical file of the database.

12. A method for verifying the authenticity of an autograph on an article comprising the steps of:

a) having a consumer provide an article to be autographed;

b) having the article autographed by a celebrity whose autograph is desired by the consumer;

c) having the consumer and a representative of an authentication company witness the autographing;

d) electronically transmitting to a computer database: a description of the article; a date and place of the autographing of the article; identification and signatures of the consumer and the representative, as witnesses to the autographing of the article; identification of a person who autographed the article; and an identifying code number;

e) affixing to the article an identifying code number;

f) providing a certificate of authenticity containing: a description of the article together with the date and place of the autographing; the name of the celebrity who autographed the article; identification of the consumer to whom the article belongs and who was witness to the autographing; and a distinct code number that is different from the code number of step D and step E.

13. A method according to claim 12 wherein said article is subsequently transferred to a new owner and a new certificate of authenticity is issued by the authentication company by carrying out the following steps:

a) having the consumer and the new owner each sign and submit to the authentication company, a request for a new certificate of authenticity;

b) having the consumer surrender the certificate of authenticity to the authentication company;

c) placing the certificate of authenticity into a physical file maintained by the authentication company;

d) having the authentication company issue a new certificate of authenticity bearing a new code number; identification of the new owner; a description of the autographed article; the date and place of autographing; the name of the celebrity who autographed the article; and e)having details of the transfer of ownership entered into the database to maintain a history of ownership of said autographed article.

14. A method according to claim 12 wherein the certificate of authenticity bears a logo identifying an entity associated with obtaining and authenticating the autographed article.

15. A method according to claim 14 wherein the entity is said authentication company.

16. A method according to claim 14 wherein the entity is a sponsoring institution.

17. A method according to claim 12 wherein the article is an article associated with a sport and is autographed by a celebrity associated with said sport.

18. A method according to claim 12 wherein the article is a book autographed by an author.

19. A system for authenticating an autographed article of memorabilia comprising:

an article to be autographed;

a unique identifying code number affixed on said article;

an autograph signed by a celebrity on said article;

a statement signed by two witnesses, attesting to their witnessing of the signing of said autograph on said article;

a certificate of authenticity containing: a description of said article; a time and place at which said autograph was signed; a name of a person who signed said autograph; identification of said two witnesses; and an identifying code number that is different from said unique identifying code number affixed to said article;

a database containing: a description of said article; the information contained on said statement and on said certificate of authenticity; the name of said celebrity; the identifying code number affixed to said article; and the identifying code number on said certificate of authenticity; and identification of a person who owns said article.

* * * * *